US005136786A

United States Patent [19]

Calagui

[11] Patent Number: 5,136,786

[45] Date of Patent: Aug. 11, 1992

[54] PLANING TOOL

[76] Inventor: Juanito Calagui, 335 Boulevard, Passaic, N.J. 07055

[21] Appl. No.: 729,410

[22] Filed: Jul. 15, 1991

[51] Int. Cl.[5] ..... B27G 17/02; B27G 23/00

[52] U.S. Cl. ..... 30/478; 30/481

[58] Field of Search ..... 30/478, 479, 481, 482

[56] References Cited

U.S. PATENT DOCUMENTS

| | | | |
|---|---|---|---|
| RE. 10,394 | 10/1883 | Campbell | 30/478 |
| 105,767 | 7/1870 | Bailey | 30/478 |
| 271,219 | 1/1883 | Campbell | 30/478 |
| 528,087 | 10/1894 | Fuller | 30/478 |
| 917,915 | 4/1909 | Vandertoorm | 30/478 |
| 1,080,546 | 12/1913 | Flanders | 30/478 |
| 1,980,737 | 11/1934 | Wolf | 30/481 |
| 2,344,897 | 3/1944 | Pringle | 30/481 |

*Primary Examiner*—Douglas D. Watts
*Assistant Examiner*—Paul M. Heyrana,Sr.
*Attorney, Agent, or Firm*—Melvin K. Silverman

[57] ABSTRACT

A low weight, high stability, disassemblable low metal content planing tool is set forth. The overall length of removeable handles is approximately equal to the longitudinal length of the tool. In narrow workspaces the tool can be operated with such handles removed.

2 Claims, 1 Drawing Sheet

PLANING TOOL

BACKGROUND OF THE INVENTION

The use of planing tools, and like means, have been known as long as woodworking has existed, however, the needs of the woodworking artisan continue to remain unsatisfied, at least in certain respects.

More particularly, an on-going need for woodworking artisans has been for a mechanically stable, physically durable portable tool in the sense that it can be assembled and disassembled as needed.

The present invention responds to the above needs by providing a planing tool in constituent parts that can readily be assembled and disassembled and which, when assembled, exhibits a high degree of stability for such a tool that is not found except in heavy, solid metal tools as are typical of the prior art.

Also, prior art planing tools are difficult to employ where the workspace is narrow in the direction of the width of the tool. The present invention also addresses the above problem.

SUMMARY OF THE INVENTION

The present invention relates to a planing tool having a solid substantially rectangular elongated blade guide, said guide defined by a planar bottom, top, and left and right sides, said blade guide including a central transverse recess therein having the geometry of an inverted solid right triangle, one surface of the said recess defining a blade support surface. The blade guide consists of front and back parts which are secured in a rigid spacial relationship by said left and right sides which comprise rigid elements. The planing tool also includes an elongated blade means having a chisel-like end, the blade means proportioned for slideable engagement along the said support surface. The tool also includes means for selectably securing a planar surface of said blade means to said support surface. Said securing means between said blade means and support surface which are function of the extent of projection of said chisel-like end of said blade means beneath said planar bottom of said blade guide. The inventive planing tool further includes gripping means transversely projecting from said blade guide at an area immediately rearwardly of said blade support surface. The length of said gripping means is approximately equal to the length of said blade guide.

It is an object of the present invention to provide a compact highly stable planing tool for use in woodworking and related activities.

It is another object of the present invention to provide a planing tool of the above type having enhanced stability and durability.

It is a further object of the inventive planing tool which minimizes the use of metal parts.

It is still further object of the planing tool which can be assembled and disassembled as required such that the constituent parts may be readily transported within a small volume.

The above and yet other objects and advantages of the present invention will become apparent in the hereinafter set forth Brief Description of the Drawings, Detailed Description of the Invention, and Claims appended herewith.

It is a yet further object to provide a planing tool having removeable, transverse handles such that the tool can be employed in narrow workspaces without use of such handles.

DETAILED DESCRIPTION OF THE INVENTION

Figure 1:
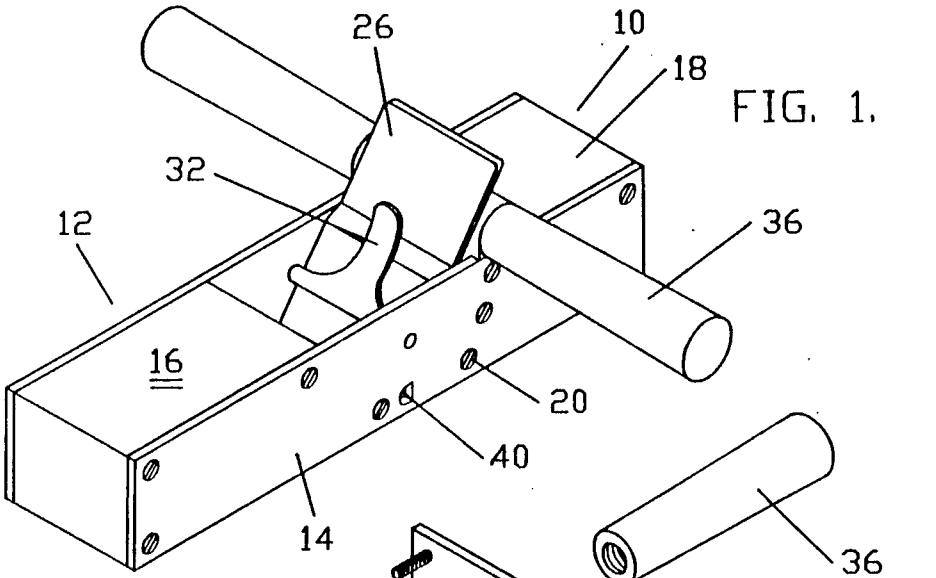
FIG. 1 is a perspective view of the instant inventive planing tool.

With reference to the perspective view of FIG. 1, the inventive planing tool is seen to include a solid substantially rectangular blade guide 10 that consists of rigid left and right sides 12 and 14. Between said left and right sides is a forward part 16 and a rear part 18 of the blade guide. As may be noted in the exploded view of FIG. 10, said forward and rear parts 16 and 18 respectively of the blade guide are secured in a desired mutual spacial configuration through screw means 20 which may be rotatably engaged within holes (not shown) within the front and rear part 16 and 18 respectively of the blade guide 10. For purposes of travel or transport, the inventive planing tool may be disassembled into its constituent parts including said left side 12, right side 14, front part 16 and rear part 18.

Figure 5:
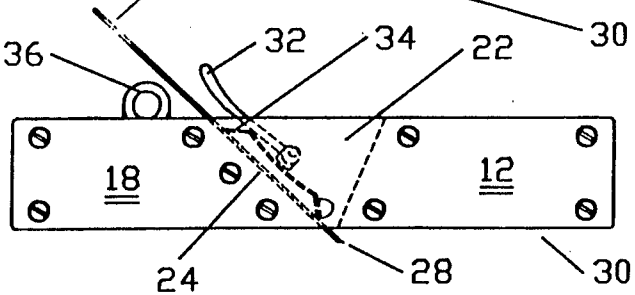
FIG. 5 is a left side view of the invention.

As may be noted in the side view of FIG. 5, said blade guide 10 exhibits a central transverse recess 22 having the geometry of an inverted solid right triangle. One surface, namely, surface 24 of recess 22 defines a blade support surface 24.

Figure 3:
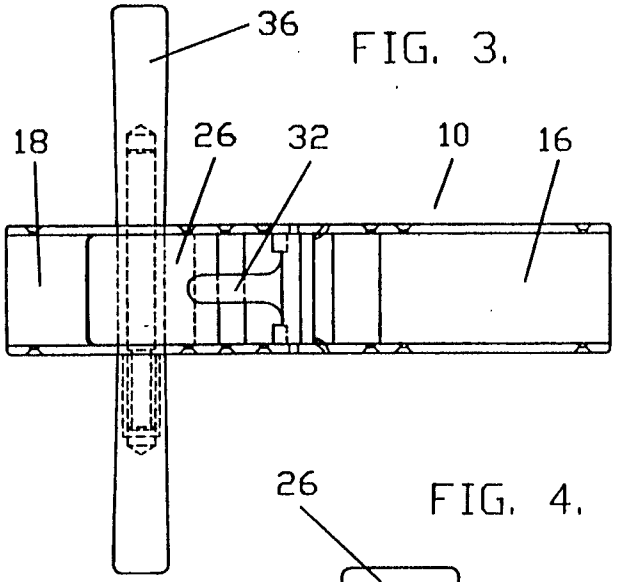
FIG. 3 is a top view of the invention.
Figure 4:
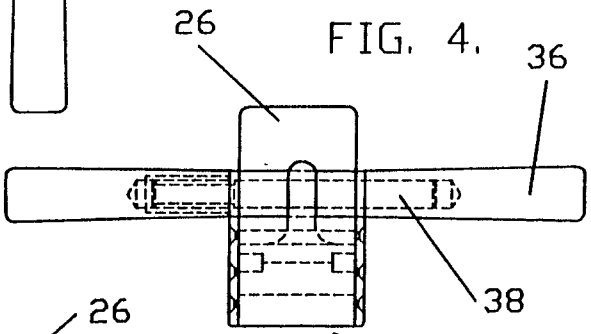
FIG. 4 is a front view thereof showing the blade support surface and blade securing means in phantom.

With reference to views 1 through 5, the inventive planing tool is seen to also include an elongated blade 26 having a chisel-like end 28 which protrudes beneath bottom 30 of the blade guide 10. Further, through FIGS. 1 and 3, it may be appreciated that said blade 26 is proportioned, for slideable engagement along said blade support surface 24.

The present planing tool is also provided with means for selectably securing said blade 26 to said supporting surface 24 at mutual positions which define the extent of protrusion by said blade end 28 beneath said planar bottom 30 of the blade guide 10. More particularly, there is provided clasp means 32 which includes a downward biasing element 34 such that the position of blade 26 relative to surface 24 may be adjusted selectably depressing the handle portion of clasp 32.

Shown within left side 12 is hole 40 within which an end of biasing element 34 may be held and stabilized.

Further shown in FIGS. 1 through 4 are gripping means 36 which project transversely (at right angles) to a longitudinal axis of blade guide 10. Such projection commences at an area immediately rearwardly of said blade support surface 24. Said gripping means 36 are positioned at a location approximately three-quarters of the longitudinal length of blade guide 10 toward the rear thereof. Further, it is to be noted, with particular reference to the view of FIG. 3, that the longitudinal length of gripping means 36 is approximately equal to the longitudinal length of blade guide 10. It has been found that the combination of such positioning of gripping means 36 rearwardly of blade 26 and the provision of an overall length of said gripping means which is approximately equal to the overall length of said guide means provides an overall structure having particular stability and ease of operation.

Figure 2:
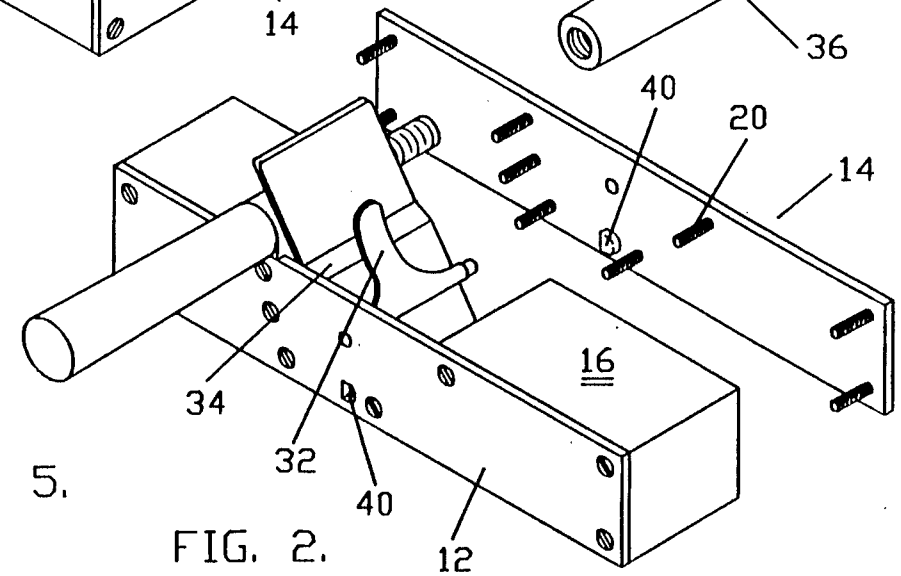
FIG. 2 is an exploded view of the right side of the tool.

As is noted in the exploded view of FIG. 2, the gripping means 36 may be selectably rotated off of threaded members 38 that are formed integrally with rear part 18 of the blade guide means. It is noted that gripping means 36 may be removed from members 38 when a user of the planing tool is operating in a workspace which is narrow in the direction of the width of the tool. In such a workspace, the tool may be held by forward and rear parts 16 and 18 respectively without need for gripping means 36. This feature is not available in planing tools heretofore known in the art.

It is to be appreciated that, if desired, gripping means having a larger diameter may, be placed upon threaded members 38.

The above described structure minimizes the use of steel and other heavy metals excepting only the blade 26, the threaded elements 38 and left and right rigid sides 12 and 14 of the planing tool which must be made of steel or other heavy metal. Either wood or a lighter metal such as aluminum may be employed for the front and rear parts 16 and 18 respectively and the gripping means 36. Thereby, a planing tool having considerable economy of size and weight, as well as the features of disassembly and stability as above discussed are achieved.

Accordingly, what has been shown, described the preferred embodiment of the instant invention, it is appreciated that the invention may be embodied otherwise than as herein is shown and described and in said embodiment certain changes may be made to the form and arrangement of the parts without departing from the idea and the principles of this invention within the scope of the claims appended herewith.

Having thus described my invention what I claim as new, useful and non-obvious and, accordingly, secure by Letters Patent of the United States is:

1. A planing tool, comprising:

(a) a solid substantially rectangular elongated blade guide defined by a planar bottom, a top, and left and right sides, said blade guide including a central transverse recess therein having the geometry of an inverted solid right triangle, one surface of said recess defining a blade support surface;

(b) blade means having a chisel-like end and proportioned for slideable engagement along said blade support surface;

(c) means for selectably securing a planar surface of said blade means to said support surface in selectable positions which are a function of the extent of projection of said chisel-like end of said blade means beneath said planar bottom of said blade guide;

(d) gripping means projecting from both sides of said blade guide parallel to said planar bottom and situated upon an axis transverse to the longitudinal axis of said blade means, said gripping means located rearwardly of said blade support surface and approximately three-quarters from the forward end of said blade guide; and (e) length of said blade guide is approximately equal to length of said gripping means and said gripping means are selectively removable from said blade guide.

2. The tool as recited in claim 1 in which said blade guide comprises:

(a) a forward portion comprising a part of the guide forwardly of said transverse recess;

(b) a rear portion, non-integral with said forward portion, comprising a part of said guide rearwardly of said transverse recess, and (c) said left and right sides of said blade guide each including means for securing surfaces thereof to opposing sides of each of said front and rear portions to thereby form a rigid structure comprising each of said sides and said front and rear portions.

* * * * *